US008857636B2

(12) United States Patent
Sullivan

(10) Patent No.: US 8,857,636 B2
(45) Date of Patent: Oct. 14, 2014

(54) SECTIONAL CONTAINER WITH A DETACHABLE BASE AND LID COVER

(76) Inventor: John Lewis Sullivan, Harrisburg, NC (US)

( * ) Notice: Subject to any disclaimer, the term of this patent is extended or adjusted under 35 U.S.C. 154(b) by 502 days.

(21) Appl. No.: 12/799,714

(22) Filed: Apr. 30, 2010

(65) Prior Publication Data

US 2011/0108507 A1 May 12, 2011

Related U.S. Application Data

(60) Provisional application No. 61/281,092, filed on Nov. 12, 2009.

(51) Int. Cl.

| | |
|---|---|
| ***B65D 1/04*** | (2006.01) |
| ***B65D 1/06*** | (2006.01) |
| ***B65D 81/32*** | (2006.01) |
| ***B65D 6/00*** | (2006.01) |
| ***A45D 34/04*** | (2006.01) |
| *A45D 40/24* | (2006.01) |

(52) U.S. Cl.

CPC ..... *B65D 81/3205* (2013.01); *B65D 11/10* (2013.01); *B65D 2203/02* (2013.01); *A45D 34/04* (2013.01); *B65D 2101/0015* (2013.01); *B65D 2101/0038* (2013.01); *A45D 2200/056* (2013.01); *A45D 40/24* (2013.01)

USPC ..... 215/6; 215/40; 215/256; 220/4.07; 220/23.83; 222/135

(58) Field of Classification Search

USPC ..... 215/6, 390, DIG. 8, 40, 256; 222/135; 220/4.07, 23.83; 206/568, 581, 807

See application file for complete search history.

(56) References Cited

U.S. PATENT DOCUMENTS

| | | | | | |
|---|---|---|---|---|---|
| 3,278,086 | A | * | 10/1966 | Clouzeau et al. | 222/135 |
| 3,851,800 | A | | 12/1974 | Swain | |
| 3,927,784 | A | | 12/1975 | Cochrane | |
| 4,166,552 | A | | 9/1979 | Faulstich | |
| 4,485,923 | A | | 12/1984 | Schwaikert | |
| 4,561,553 | A | | 12/1985 | Crisci | |
| 4,618,076 | A | | 10/1986 | Silvenis | |
| 4,779,722 | A | * | 10/1988 | Hall | 206/221 |
| 4,919,286 | A | * | 4/1990 | Agbay, Sr. | 215/235 |
| 5,009,342 | A | | 4/1991 | Lawrence | |
| 5,332,157 | A | | 7/1994 | Proctor | |
| 5,413,251 | A | | 5/1995 | Adamson | |
| 5,464,129 | A | | 11/1995 | Ho | |
| 5,472,119 | A | | 12/1995 | Park et al. | |
| 5,553,727 | A | | 9/1996 | Molinaro | |

(Continued)

*Primary Examiner* — Sue A Weaver

(74) *Attorney, Agent, or Firm* — Tillman Wright, PLLC; James D. Wright; David R. Higgins

(57) ABSTRACT

A sectional liquid dispensing container for lotions, creams, cleansers, etc. that includes a finger actuated pump assembly and an extending dip tube. The container has three individual sections; the upper section of container contains a tamper evident closure member at its lower most edge. The lower section (base) contains a closure member incorporated onto its top edge and designed to snap fit into upper section. A lid cover snaps onto the bottom surface of the lower section using a tamper evident closure member design. The usage of perimeter closure members provide for easy removal of locking tear-off bands that allows for separation of each section and provides access to remaining container contents. The container provides for dual dispensing (two individual products) from one container when the upper section has been modified into a separate enclosure. Two finger actuated pump assemblies may be used for dispensing various compatible products.

3 Claims, 11 Drawing Sheets

(56) References Cited

U.S. PATENT DOCUMENTS

| | | | | |
|---|---|---|---|---|
| 5,647,481 | A | 7/1997 | Hundermark | |
| 5,740,947 | A | 4/1998 | Flaig | |
| 5,794,819 | A | 8/1998 | Smith | |
| 5,881,918 | A * | 3/1999 | Eichler | 222/135 |
| 5,975,364 | A | 11/1999 | Kaufman | |
| 6,135,323 | A | 10/2000 | Chen | |
| 6,170,708 | B1 * | 1/2001 | Chen et al. | 222/135 |
| 6,253,945 | B1 * | 7/2001 | Lee | 220/23.86 |
| 6,474,861 | B1 * | 11/2002 | De Laforcade | 366/130 |
| 6,543,645 | B2 * | 4/2003 | Lacout | 222/129 |
| 6,604,655 | B1 * | 8/2003 | Lee | 222/135 |
| 2004/0262173 | A1 * | 12/2004 | Buesching et al. | 206/217 |
| 2006/0272963 | A1 * | 12/2006 | Sharon | 206/219 |
| 2007/0267446 | A1 * | 11/2007 | Pressler | 222/192 |
| 2009/0194531 | A1 * | 8/2009 | Branco | 220/23.83 |

* cited by examiner

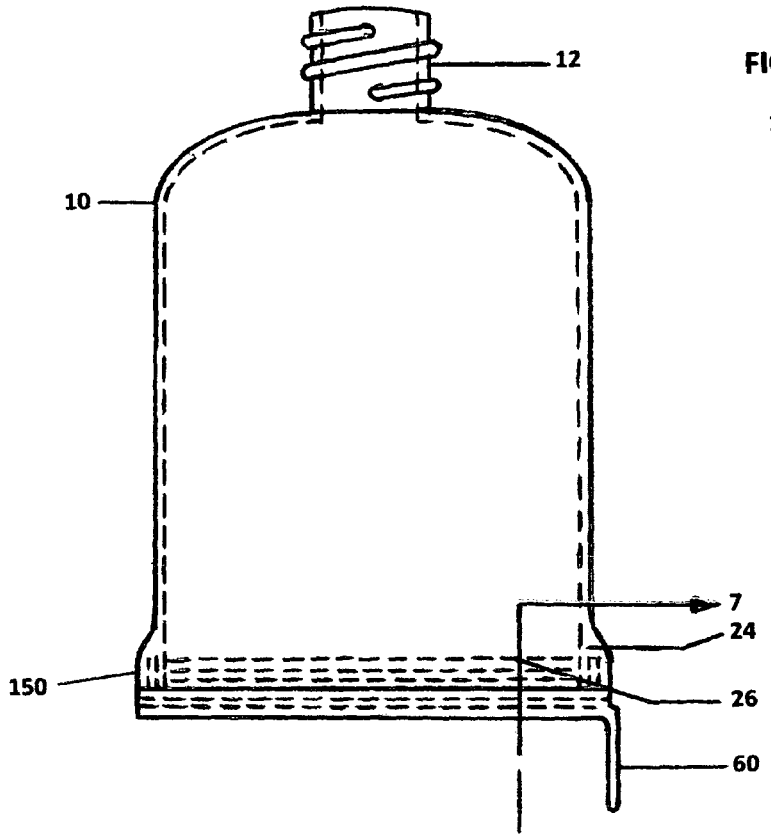
FIG. 2
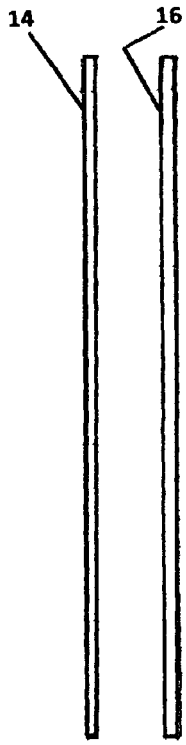
FIG. 5
FIG. 5A
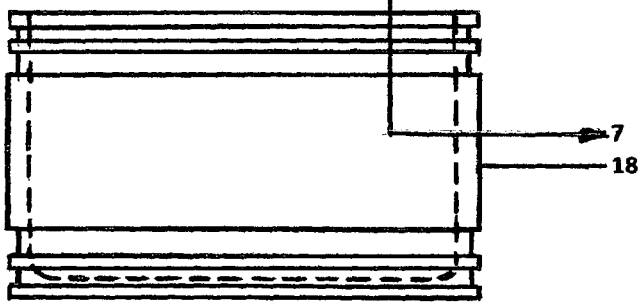
FIG. 3
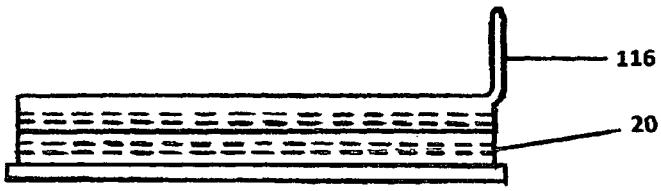
FIG. 4

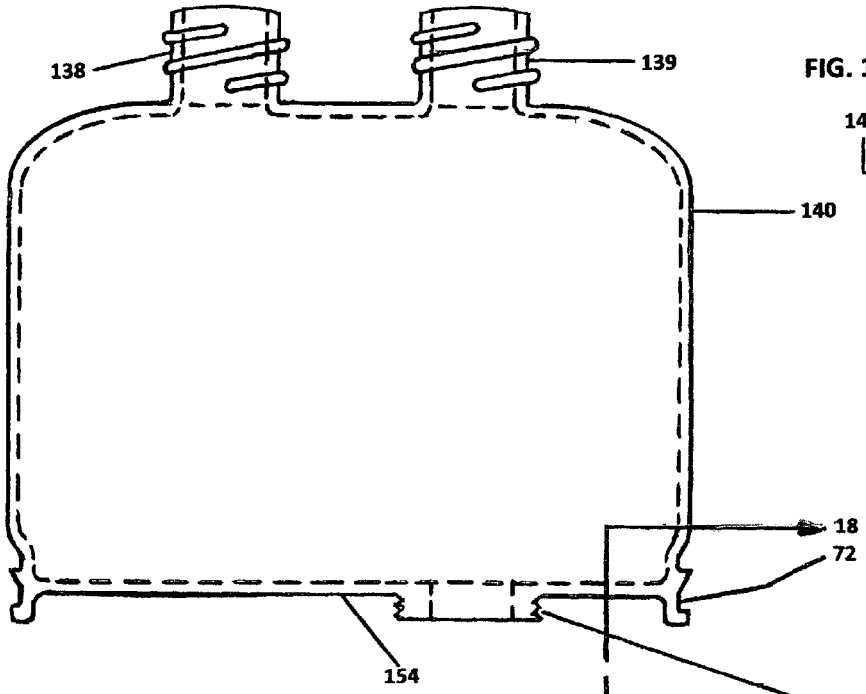
FIG. 13
FIG. 16
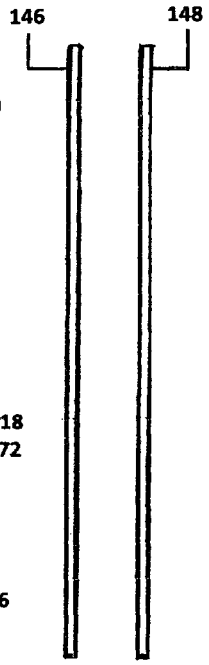
FIG. 16A
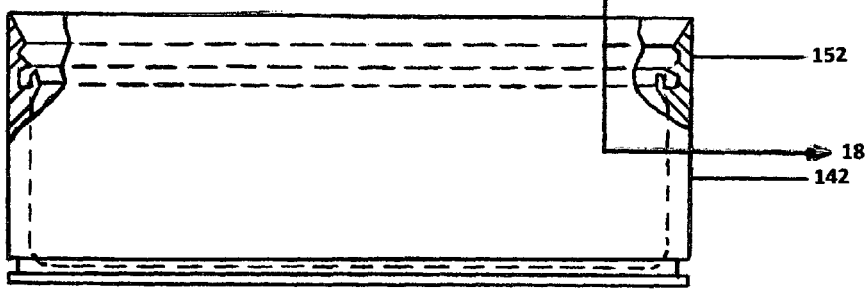
FIG. 14
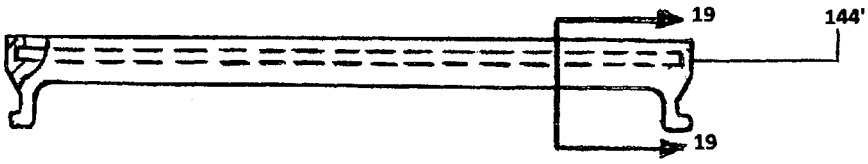
FIG. 15

FIG. 21
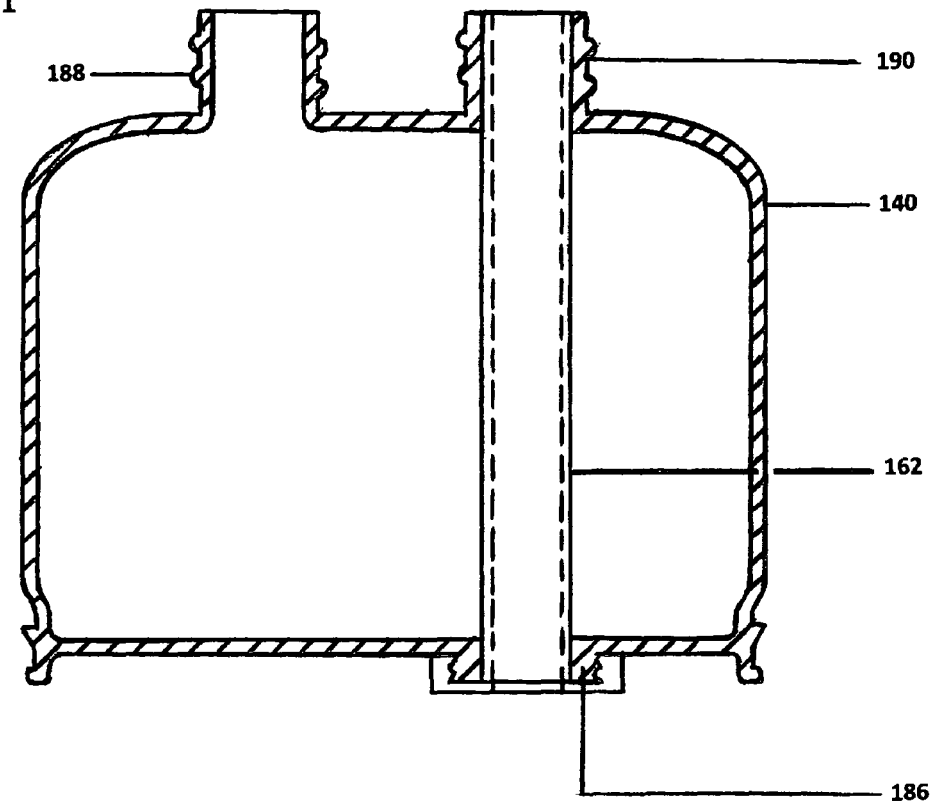
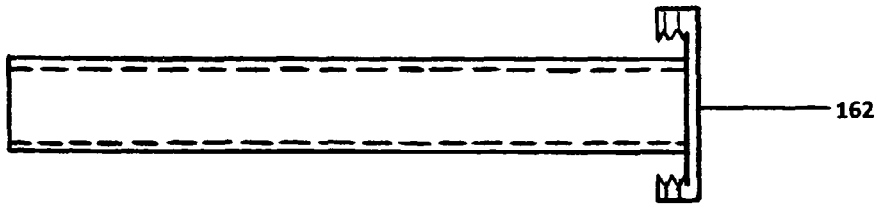
FIG. 22

SECTIONAL CONTAINER WITH A DETACHABLE BASE AND LID COVER

CROSS-REFERENCE TO RELATED APPLICATIONS

This application claims the benefit of provisional patent application Ser. No. 61/281,092, filed Nov. 12, 2009 by the present inventor.

BACKGROUND OF THE INVENTION

1. Field of the Invention

This invention generally relates to leak proof plastic containers or bottles, which are used to dispense healthcare lotions and creams. In particular, containers or bottles, which are capable of being separated into two individual sections.

2. Brief Discussion of the Related Art

Plastic containers come in many shapes, sizes, and colors. Containers of this type are usually made of such plastics as PET (Polyethylene Terphthalate), PVC (Polyvinyl Chloride), or HDPE (High Density Polyethylene) and manufactured using blow or injection molding techniques. Lotions, creams, and body soap dispenser containers are generally molded with a neck at the top of a container, which receives a finger actuated pump assembly, to dispense liquid contents. Most lotion containers have a single unit for storing liquids and are disposable once pump assembly is no longer capable of dispensing its contents.

One problem with the existing containers is that they allow a portion of the liquids to remain in the containers after their primary means of dispensing is exhausted, therefore, a large amount of the product is eventually thrown away. Manufacturers have designed other containers, (i.e. squeeze tubes and inverted tubes) in an effort to make consumers think that these products allow them to use all the liquids within its container. However, in most cases, liquids remain within these containers regardless of consumer efforts at retrieving them.

The present container has an upper section and a lower section (base) assembled together by means of a tamper evident closure assembly which, as assembled, constitute the sectional container. Upon separation into its individual sections, said container provides consumers access to the remaining liquids. Additionally, attached to the bottom of lower section (base) is a lid cover that is used to protect those liquids that remain in the lower section (base). Said lid cover is initially attached to the base by compression fitting said tamper evident closure lid onto beads molded onto the periphery of the lower section (base).

The separation of the upper section is made possible by removing the frangible band that locks it onto the lower section (base). Similar, prior tamper evident closure caps have performed the basic function of providing only secure capping of container contents. The present container provides a sectional container that provides access to the container liquids that in most cases would be lost to individual consumers; especially with those containers having more heavier bodied liquids. The present container provides for an additional feature, a lid cover for said base container. Said cover is attached underneath the base containers bottom by a compression fitted (push on) assembly operation.

Previously, tamper evident closures as shown in U.S. Pat. No. 5,553,727 which issued to Consumer Cap Corporation, as well as many others provide for simple secure capping of a container at its opening. Thus these closure designs provide only secure tamper evident closure and the ability for temporary re-capping of the opening. The present container provides tamper evident closure and expands the realm of its design usage, by expanding the vessel to which it is applied. The present container takes the tamper evident closure feature and creates a new type of application, a connector for components, thus giving the realized container additional usage. The additional usage includes, not only the accessing of liquids, that would have otherwise been lost, but now the consumer has gained the use of a base and lid cover. A base and cover that can be re-filled (as consumers re-purchase new product) with additional liquids, which can be used in other rooms or for travel purposes. The resulting base and lid cover can be compared to the individual cream and lotion jars currently in the marketplace. While the presently preferred embodiment of the container or bottle is made with the use of plastics, other suitable materials maybe used. Such materials include, but are not limited to rubber, waterproof fabrics, collapsible metals, etc.

There are groups of tamper evident closure assemblies of various designs that rely on different interlocking designs. They include threads, teeth and/or serrations in order to achieve closure assembly. Said closure designs, having these extending threads, with respect to cylindrical containers are adaptable and can be used with present container. Said present tamper evident closure band, in its new design can be used with cylindrical containers as well as other non-cylindrical containers to provide an alternate application in container design. Other closures; such as shown in U.S. Pat. No. 5,553,727 to the Consumer Cap Corporation and many others illustrate possible thread designs. Thus by incorporation of such thread designs within the design and scope of present containers supplements its utility. Hence, the present container design provides for a liquid tight seal for a sectional container, created by accurate sealing surfaces of its molding process and design, and thus expands its usage beyond simple round one cavity containers e unlimited container shapes and sizes.

SUMMARY OF THE INVENTION

In accordance with one embodiment, a sectional hollow body container with a detachable base and lid cover designed to receive a disclosed thumb actuated pump assembly. Sectional members are joined together by compression fitting sections using a mold integrated tamper evident closure members. The base is detachable by removing the frangible tear-off band and pulling the two sections apart. The inclusion of a detachable lid cover allows for the covering and protecting of liquids that remains in container when the primary dispensing function fails.

The hollow body container provides a tightly sealed container capable of being separated into individual sections. In its assembled design, an upper section and a lower section, provides the function of a one piece container. When present container is sectionalized, the lower section provides consumers access to liquids that remain at the bottom of said containers. Thus, the present container gives those consumers who purchase body lotions and creams, the usage of liquids often discarded with the usage of prior designs. Consumers can realize some monetary savings within their healthcare budget with the usage of present invention.

In another embodiment of the container, a dual dispensing container is made by converting the upper section of the container into a separately enclosed unit. A second finger actuated pump assembly is attached to an additional mold incorporated neck, along with a channel that allows for extending the dip tube to the bottom of the lower section. This container allows for dispensing liquids that consumers would use in a combination (i.e. hair conditioners and shampoo, facial scrubs & facial lotions, hand sanitizer and hand lotions, etc.). This container gives consumers the additional benefit of having two key healthcare products in one package and the ability to use either product without the need to physically handle products for usage, thus eliminating the possibility of one of the products slipping from your hands during usage.

Thus, the present container uses the tamper evident perimeter closure member attachment in an innovative manner, a connector, that opens up new opportunities of function. The perimeter closure member assembly makes it virtually impossible to tamper with product contents without showing signs of tampering, thereby forming a sectional hollow body container manufactured into three individual components and assembled together by compression fitting each together.

BRIEF DISCUSSION OF THE DRAWINGS

FIG. 2 is a front view of upper section; said finger actuated pump removed;

FIG. 3 is a front view of lower section (base);

FIG. 4 is a front view of lid cover;

FIG. 5 is a side view of the front product label;

FIG. 5A is a side view of the rear product label;

FIG. 13 is a front view of the upper section of said dual dispensing embodiment;

FIG. 14 is a front view of the lower section (base) of dual dispensing embodiment;

FIG. 15 is a front view of the lid cover of said dual dispensing embodiment;

FIG. 16 is a side view of front labels of dual dispensing embodiment;

FIG. 16A is a side view of rear labels of dual dispensing embodiment;

FIG. 21 is a sectional view of the interior structure of said upper section of dual dispensing embodiment, with the interior channel (item 162) in its assembled position;

FIG. 22 is a front view of the interior channel (item 162) of said alternate embodiment;

DETAILED DESCRIPTION OF THE PRESENTLY PREFERRED EMBODIMENT

Figure 1:
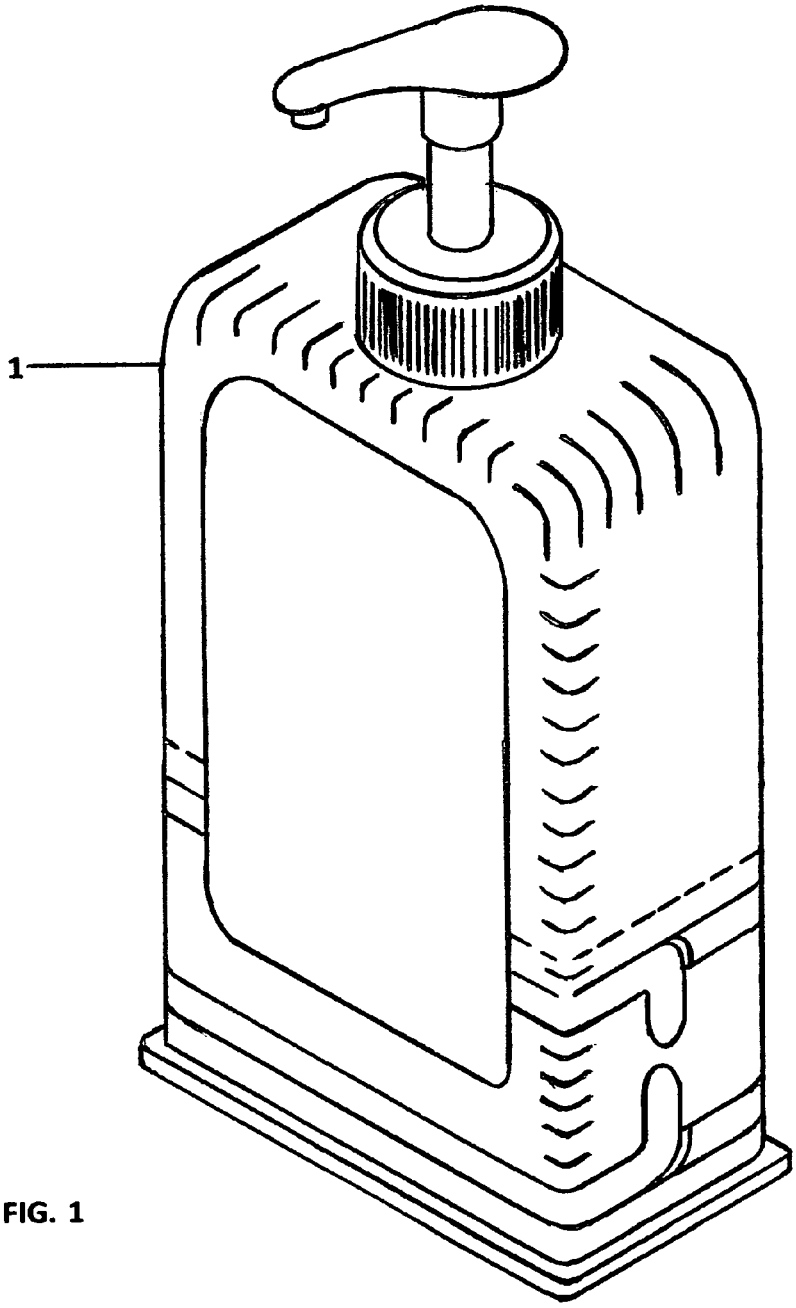
FIG. 1 is a perspective view of a presently preferred embodiment.
Figure 8:
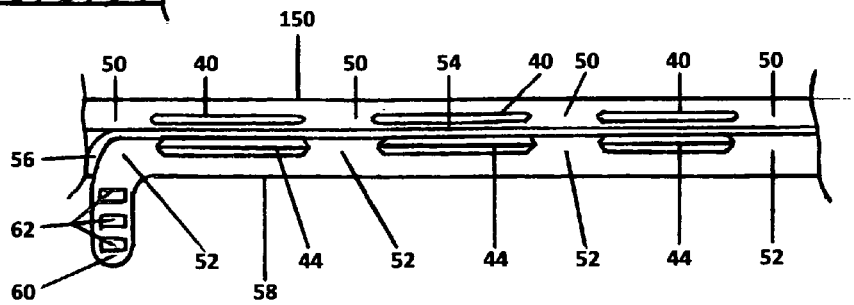
FIG. 8 is a schematic view of the interior of the perimeter closure member and frangible tear-off band of sectional view (6-6)

As shown in FIG. 1, FIG. 1A, FIG. 2, FIG. 3, and FIG. 4, the presently preferred container 01 as shown in FIG. 1 is a hollow body container and is manufactured to receive a disclosed finger actuated pump dispenser PD which attaches to the top edge of presently preferred container 01 by attachment to the upwardly extending neck 12 of the containers upper section 10. The pump dispenser PD may be of any commercially available type such as finger-operated pumps used for dispensing healthcare lotions, creams, and soaps. Said hollow body container consisting of upper section 10 and lower section (base) 18 while assembled will provide for the same function as current single piece containers. Upper section 10 is a hollow body component preferably molded of light weight thermoplastic suitable for manufacture to include beads, ridges and frangible tear-off bands, as discussed later. A lower section (base) 18 is a hollow body component preferably molded of light weight thermoplastic suitable for manufacture to include beads, ridges and frangible tear-off bands, also discussed later. Lower section (base) 18, in its assembled position is locked into the bottom edge of said upper section 10 by means of the frangible tear-off band 60 as shown in FIG. 8. Attached underneath said lower section (base) 18 and locked into its assembled position by means of the frangible tear-off band 116 is the detachable lid cover 20 as shown in FIG. 4. Front product adhesive label 14 and rear product adhesive label 16 are assembled respectively to said presently, preferred container 01. The term container, used herein is deemed to include a bottle.

Referring to FIG. 1A, FIG. 2, FIG. 3, FIG. 4, and FIG. 5, assembly of the upper section 10 and the lower section (base) 18 is performed by means of a downward movement of upper section 10 from the position of FIG. 2 to the seated position of FIG. 1. An upper perimeter closure member 150 with an attached frangible tear-off band 60 stretches to permit slanted neck beads of the lower section (base) 18 to slide over the ridged surfaces of the frangible tear-off band 60. Continued downward compression of said upper section 10 is applied until the vertical neck 74, shown in FIG. 7 of the lower section (base) 18, snaps into its position against the bottom surface of angled top wall 24. This position, which locks the two sections together provides for a tightly sealed presently preferred container 01.

Figure 6:
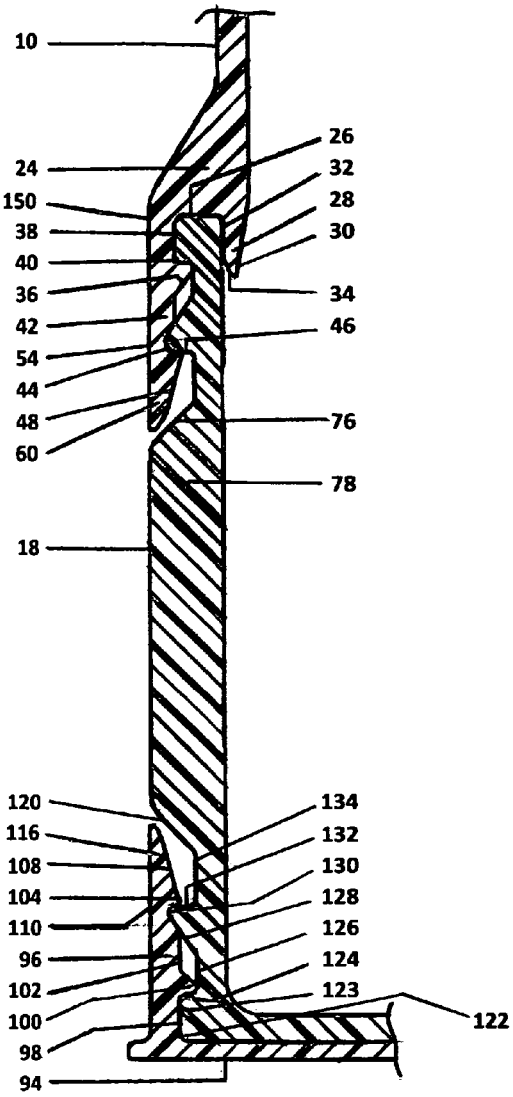
FIG. 6 is an enlarged vertical sectional view (6-6) of the structure of container walls and neck.

FIG. 3, FIG. 4 and FIG. 6 show that the lower section (base) 18 has molded onto the bottom periphery thereof first external bead 123 and second external bead 130, as best shown in FIG. 6 that provide mating shoulders for attachment of lid cover 20 with the mating internal lower bead 100 and internal upper bead 104. Shown in the upper edge of lower section (base) 18 internal first bead 40 and internal lower bead 44 provide mating shoulders with external neck bead 80 and external neck bead 86 during assembly. Said lid cover 20 has molded into its uppermost edge a frangible tear-off band 116 shown in FIG. 9. Frangible tear-off band 116 stretches upon alignment and compression to permit said internal lower bead 100 and internal upper bead 104 to slide over and lock in assembly with first external bead 123 and second external bead 130 of lower section (base 18).

FIG. 5 and FIG. 5A shows the front product adhesive label 14 and rear product adhesive label 16 are positioned and placed in desired locations. Front product adhesive label 14 and rear product adhesive label 16 are manufactured to contain perforated lines that are aligned with the tear lines of said frangible tear-off band 60 of upper perimeter closure member 150. In the assembled position, front product adhesive label 14 and rear product adhesive label 16 also provide additional closure and seal protection for container contents.

Figure 9:
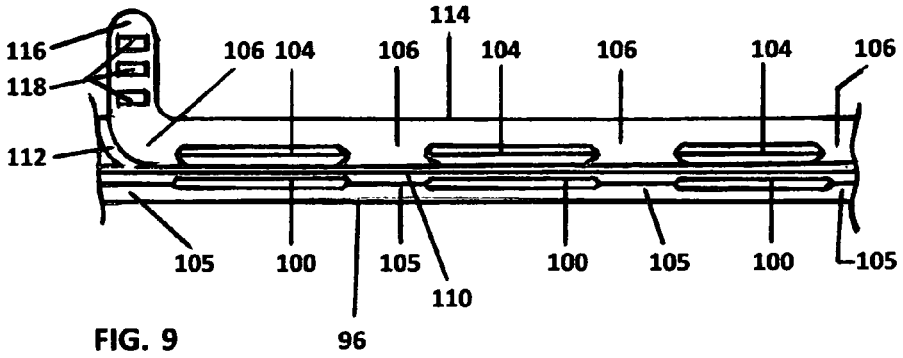
FIG. 9 is a sectional view (6-6) of the interior of the lower perimeter closure member and the attached frangible tear-off band; and the intersections of the upper and lower locking beads of the lid cover.

Considering the separation of presently preferred container 01 and shown in FIG. 1, FIG. 2, FIG. 3, and FIG. 4, said sectional presently preferred container 01 is divided into its individual components by gripping frangible tear-off band 60 and tearing said frangible tear-off band 60 at the horizontal tear line 54 along the circumference of said presently preferred container 01, completely removing said frangible tear-off band 60 away from said presently preferred container 01. The removal of said frangible tear-off band 60 releases each component from the tight and secure connection obtained at assembly. Complete separation of presently preferred container 01 requires gripping upper section 10 and the lower section (base) 18 and snapping in a twisting and lifting motion each apart at the connection made possible at said upper perimeter closure member 150. The realized lower section (base) 18 obtained upon separation of presently preferred container 01 can then be used as a separate container with the detached lid cover 20 to protect and covering of access product contents. FIG. 6 and FIG. 9 show that the removal of the frangible tear-off band 116 releases lid cover 20 from its tight and secure connection obtained at assembly. Removal of said frangible tear-off band 116 requires gripping and tearing the horizontal tear line 110 along the circumference of presently preferred container 01 removing said frangible tear-off band 116 away from its attached position. To remove lid cover 20 from the bottom edge of presently preferred container 01 requires gripping and snapping lid cover 20 out of the remaining connection of first external bead 123 and first internal lower bead 100. Upon detaching both lower section (base) 18 and lid cover 20 from their assembled position shown in FIG. 1A, the lid cover 20 can now be snapped onto the mating beads on the top edge of lower section (base) 18, thus providing for a cover for the resulting lower section (base) 18.

FIG. 6 also shows sectional view 6-6 of presently preferred container 01. Upper section 10 comprises along the bottom edge an angled top wall 24 having a interior planar surface 26. Suspended from the underside of said angled top wall 24 is an interior skirt 28 which is relatively short and has a downwardly slanted inner sealing surface 32, a substantially vertical inner wall 30, a inwardly downwardly tapered edge 34 which merges with the lower edge of inner sealing surface 32.

Outwardly spaced from said interior skirt 28 is said upper perimeter closure member 150 which has a substantially vertical outer wall. The inner wall of said upper perimeter closure member 150 and extending down from internal planar surface 26 is a substantially vertical top wall 38 of a length about equal to that of interior skirt 28, which terminates at internal first bead 40. The curved vertical wall 42 just below internal first bead 40 terminates at said horizontal tear line 54. Horizontal tear line 54 merges with the slanted top surface 46 which intersects with the inclined lower surface 48 to form internal lower bead 44. FIG. 8, shows that the internal first bead 40 and internal lower bead 44 are not continuous (not circumferential) but are interrupted with short upper gap 50 and lower gap 52, respectively. Hence, the wall thickness of said upper perimeter closure member 150 at said upper gaps 50 and lower gap 52 are thinner than at internal first bead 40 and internal lower bead 44. This permits stretching of said upper perimeter closure member 150 during assembly. Said upper internal first bead 40 between upper gaps 50 are longer than upper gaps 50, quantity and size may vary. It should be noted that a minimum of four upper gaps 50 and four lower gap 52, as best shown in FIG. 8, are recommended to aid in assembly. Said internal lower bead sections 44 are longer than lower gaps 52. The internal first beads 40 prevent container upper section 10 from being removed when upper perimeter closure member closure 150 having frangible tear-off band 60 is attached. Spaced immediately above the top surface of internal lower bead 44 is horizontal tear line 54, formed on the interior of upper perimeter closure member 150 to permit tearing and removal of frangible tear-off band 60. Turning to FIG. 8, extending downwardly in a slightly spiral configuration is a spiral groove 56 which extends from lower edge of bottom skirt edge 58 of said upper perimeter closure member 150 to merge with the horizontal tear line 54. A frangible tear band-off band 60 which may be easily gripped with the fingers extends from the bottom skirt edge 58 immediately to one side of spiral groove 56. To facilitate gripping frangible tear-off band 60 raised traverse ridge 62 may be formed thereon. It will be noted that the slanted top surface 46 of internal lower bead 44 is spaced downwardly within the horizontal tear line 54.

Figure 7:
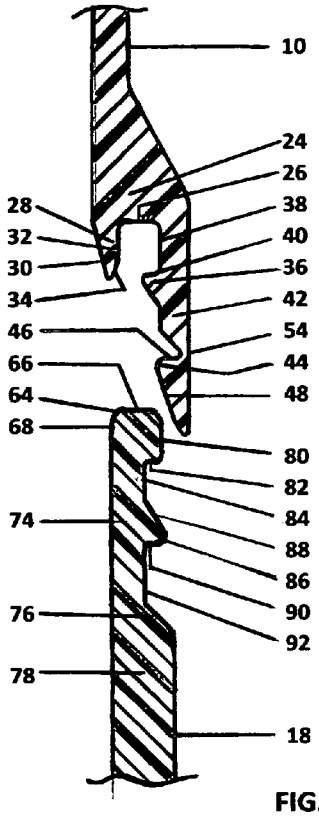
FIG. 7 is an exploded view of the structure of FIG. 6 (upper section) showing the perimeter closure members disassembled.

FIG. 3, FIG. 6 and FIG. 7 which shows a vertical neck 74 of lower section (base) 18 and located at the top edge is a thick horizontal in-turned top flange 64 having substantially flat horizontal sealing surface 66 dimensioned to fit against the underside of said angled top wall 24 between interior skirt 28 and upper perimeter closure member 150. The interior surface of vertical neck 74 has proceeding downwardly from horizontal sealing surface 66 at a substantially right angle, a short first vertical seal surface 68. Said vertical seal surface 68 seats against interior skirt 28 causing it to bend slightly inward forming a liquid tight seal. Said vertical sealing surface 68 is extremely smooth and continuous and extends to the bottom interior surface of the lower section (base) 18.

The exterior of vertical neck 74 is shown in FIG. 7 and extending vertically downward from horizontal sealing surface 66 is an external neck bead 80 which terminates at a sharp angle with upper horizontal shoulder 82. The length of the external neck bead 80 is such that the internal first bead 40 of the upper perimeter closure member 150 in assembled condition seats immediately under upper horizontal shoulder 82 and holds the upper container upper section 10 in position, even when the horizontal tear line 54 has been torn. Below the upper horizontal shoulder 82 is a second vertical exterior surface 84 which is substantially lesser in diameter than external neck bead 80. Said vertical external surface 84 terminates at external neck bead 86 and external neck bead 86 has an outwardly-downwardly upper slant surface 88 which is rounded and merges with lower horizontal shoulder 90. Below external neck bead 86 is a third lower vertical surface 92 which then merges with the external surface of the thicken base wall 78 formed by the intersection of exterior angled surface wall 76 and vertical neck 74.

FIG. 2, FIG. 3, FIG. 7 and FIG. 8 show the assembly of upper section 10 and lower section (base) 18 which are assembled by aligning upper perimeter closure member 150 with the extended vertical neck 74 and then with a downward movement of upper section 10 from the position of FIG. 2 applying downward pressure to seat each together as in FIG. 1. Upper perimeter closure member 150 stretches to permit the inclined lower surface 48 of internal lower bead 44 to slide over external neck bead 80 and then slide over second external neck bead 86. Similarly, the rounded first bead 40 slides over said upper horizontal shoulder 82 and external neck bead 80. In the seated position of FIG. 1 first bead 40 is seated under the upper horizontal shoulder 82 and internal lower bead 44 is seated under the lower horizontal shoulder 90. There is a tight liquid seal between the vertical inner wall 30 of the interior skirt 28 and the vertical seal surface 68 which are extremely smooth. Horizontal seal surface 66 seats against the underside of angled top wall 24 and external neck bead 80 and vertical top wall 38 accurately seat together at assembly. Hence, an extremely tight seal is made possible.

To separate presently preferred container 01 of FIG. 1, said consumer should first grip said frangible tear-off band 60 and pull upwardly causing upper perimeter closure member 150 to tear along said horizontal tear line 54 with the continued pulling of frangible tear-off band 60 until complete detachment from presently preferred container 01 is achieved. To remove the upper section, consumer then applies an upward prying force against said upper section 10 thus breaking the seal at internal first bead 40 and upper horizontal shoulder 82.

Lid cover 20 as illustrated in FIG. 4 and shown best in detailed in FIG. 6, the lower portion of the sectional view (6-6) details the bottom edge of said lower section (base) 18. Said lid cover 20 comprises a bottom disc 94 having a planar under surface with a lower perimeter closure member 96 similar in design of said upper perimeter closure member 150. Lid cover 20 does not include interior skirt 28 as detailed in upper section 10. Extending upward from the top of said bottom disc 94 a short vertical wall 98 that terminates at the internal lower bead 100. At internal lower bead 100 there is an air tight seal formed against lower horizontal shoulder 124, as best shown in FIG. 6. Above said internal lower bead 100 is an outwardly slanted surface 102 which terminates at the lower horizontal tear line 110. At internal upper bead 104 there is an air tight seal formed against upper horizontal shoulder 132, as best shown in FIG. 6. Above horizontal tear line 110 is said internal upper bead 104 which merges with a substantially upwardly-outwardly inclined upper surface 108, which represents the surface area of the frangible tear band 116.

The angled external surface 120 of said lower section (base) 18 slants inwardly and down to terminate at intersecting vertical wall 134. Upper horizontal shoulder 132 intersects with said intersecting vertical wall 134 which extends to form a second external bead 130. Below said external bead 130 and extending down and inwardly is an outwardly slanted surface 128 which intersects with a lower external vertical wall 126. Said lower external vertical wall 126 ends at the lower horizontal shoulder 124 which connects with first vertical surface 122 creating first external bead 123. Said vertical surface 122 extends to form bottom surface of lower section (base) 18. Said bottom disk 94 of lid cover 20 has a relative flat interior surface with no interior sealing walls.

As is best shown in FIG. 6 and FIG. 9 internal lower bead 100 and internal upper bead 104 are not continuous (not circumferential) but are interrupted with lower short gaps 105 and upper short gaps 106, respectively. The wall thickness of the lower perimeter closure member 96 at the lower short gap 105 and upper short gap 106 is considerably thinner than at said internal lower bead 100 and internal upper bead 104. The various wall thickness permits stretching of said lower perimeter closure member 96 during assembly. Said internal upper bead 104 between said upper short gap 106 are considerably longer than upper short gap 106 and allow for stretching during assembly. Said internal lower beads 100 are considerably longer than lower short gaps 105 which allow for stretching during assembly. Said internal lower beads 100 prevent lid cover 20 from being removed when said lower perimeter closure member 96 is intact, as shown in FIG. 9. Spaced immediately above the top surface of internal lower bead 100 is horizontal tear line 110 formed on the interior of lower perimeter closure member 96 to permit easy tearing. Extending upwardly in a slightly spiral configuration is spiral tear groove 112 which extends from the top skirt edge 114 of lower perimeter closure member 96 to merge with said horizontal tear line 110. Said frangible tear-off band 116 which may be easily gripped by fingers ends at the upwardly turned edge, forming a short tab at its edge. To facilitate gripping frangible tear-off band 116 raised traverse ridge 118, as best shown in FIG. 9 may be formed thereon. It will be noted that the upper short gap 106 and upper bead 104 are spaced downwardly from the horizontal tear line 110.

Figure 1A:
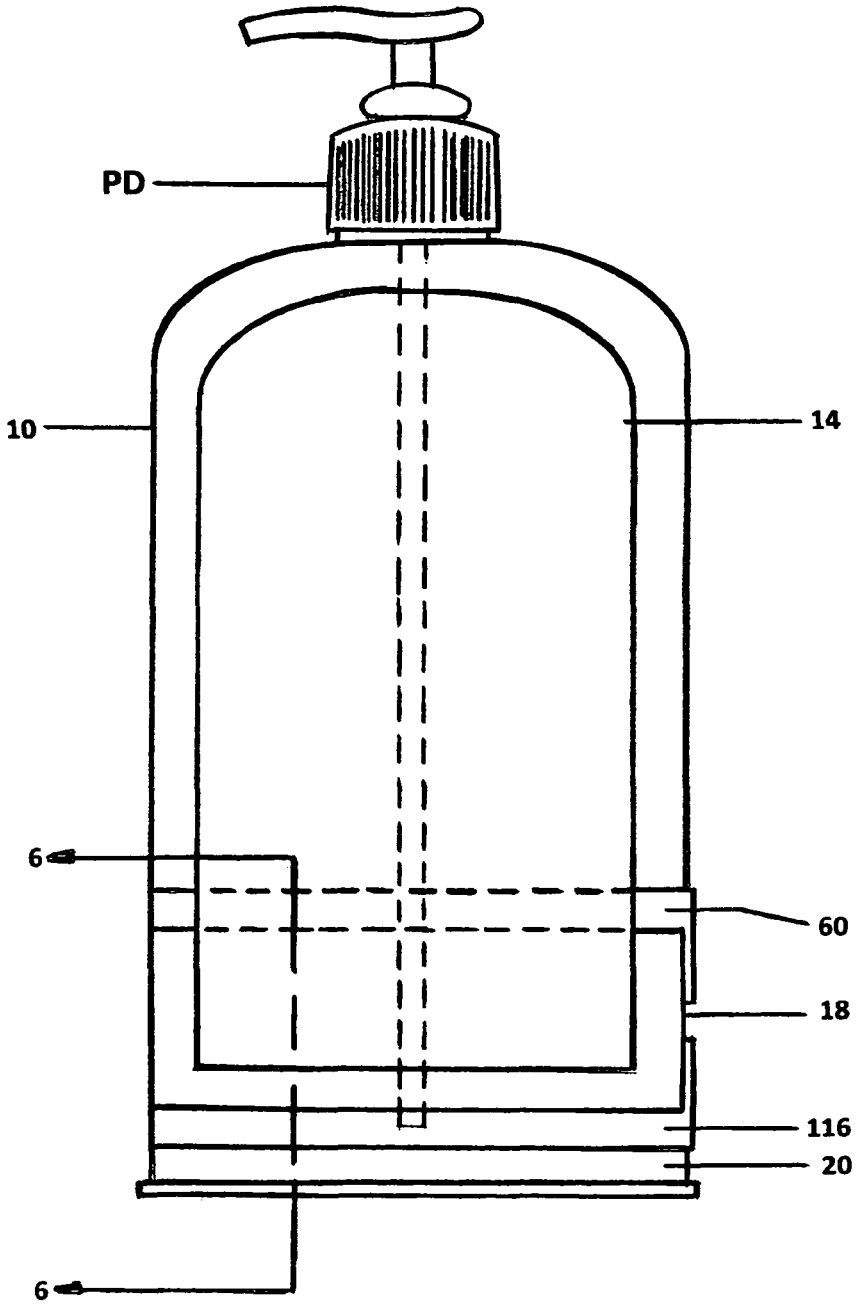
FIG. 1A is a front view with the disclosed finger actuated pump assembled.

FIG. 1, FIG. 1A, FIG. 4, FIG. 6 and FIG. 9 When the consumer decides to separate said lid cover from the assembled position as shown in FIG. 1A, consumer should first grip frangible tear-off band 116 as best shown in FIG. 6, and pull outwardly causing said lower perimeter closure member 96 also best shown in FIG. 6, to tear along said spiral tear groove 112 as best shown in FIG. 9. The consumer should continue to pull frangible tear-off band 116 outwardly along horizontal tear line 110 so that entire frangible tear-off band 116 is removed. To remove lid cover 20, the consumer then grips and applies a downward prying force against the bottom disk 94 thus breaking the seal at internal lower bead 100 which removes said lid cover 20 from its assembled position.

DETAILED DESCRIPTION OF OTHER PRESENTLY PREFERRED EMBODIMENTS

Figure 6A:
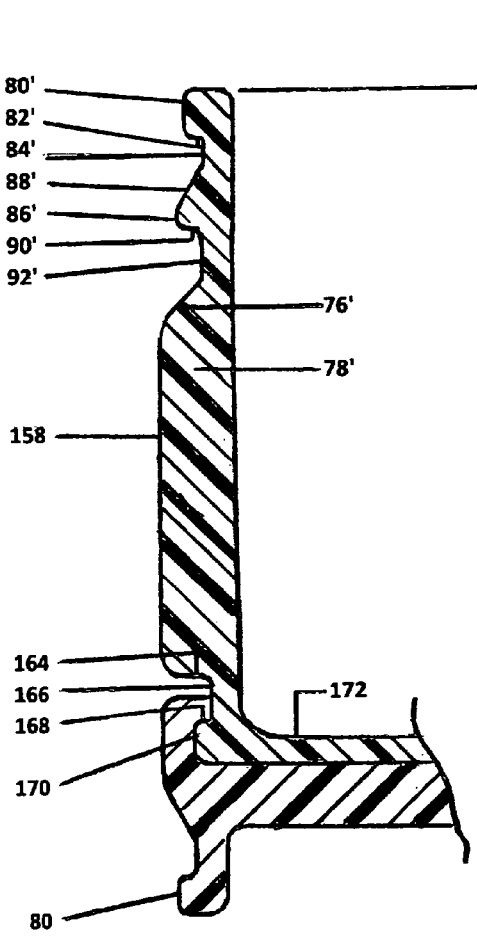
FIG. 6A is an enlarged vertical sectional view (6A-6A) of the alternate lower section (base) structure of container walls.
Figure 10:
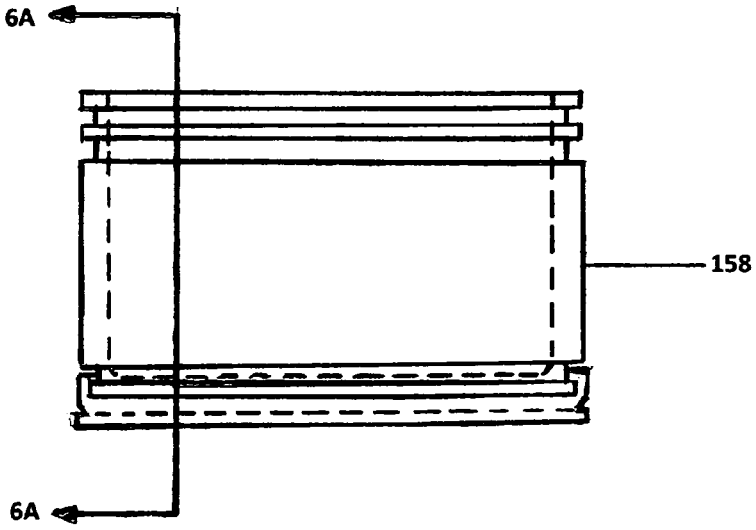
FIG. 10 is a front view of alternate design of lower section (base)
Figure 11:
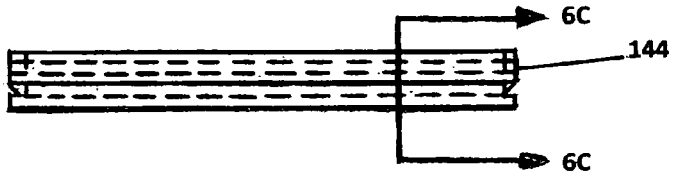
FIG. 11 is a front view of the alternate design of the snap-on lid cover.

Shown in FIG. 10 is the alternate base 158 and FIG. 11 shows an alternate lid cover 144 which provides for a multi-functional attachment of various product storage compartments which can be used on both presently preferred container 01 as well as the dual dispensing container design 135. In FIG. 6A the upper top edge of said alternate base 158 includes said vertical neck 74' which remains unchanged in design with said presently preferred container 01. In the exploded sectional view (6B-6B) of alternate base 158, there is a thick horizontal in-turned top flange 64' having a substantially flat horizontal sealing surface 66' dimensioned to fit against the underside of angled top wall 24' between interior skirt 28' and upper perimeter closure member 150' as shown in FIG. 7. Describing first the interior surface of vertical neck 74', proceeding downwardly from horizontal sealing surface 66' at a substantially right angle is a short first vertical seal surface 68'. Said vertical seal surface 68' seats against interior skirt 28' causing it to bend slightly inward, forming a liquid tight seal. Said vertical seal surface 68' is extremely smooth and continuous and extends to the bottom interior surface of alternate base 158.

Figure 6B:
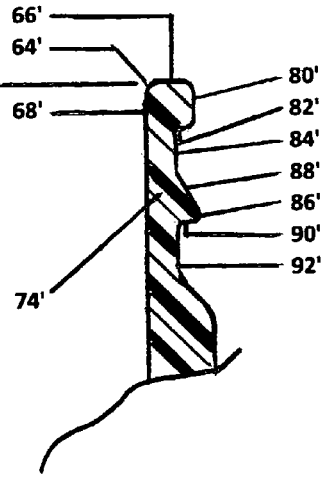
FIG. 6B is an enlarged vertical sectional view (6A-6A) of the alternate lower section (base) structure of container extending neck.

The exterior of vertical neck 74', shown in FIG. 6B and extending vertically downward from horizontal seal surface 66' is an external neck bead 80' which terminates at a sharp angle with upper horizontal shoulder 82'. FIG. 6 shows that the length of external neck bead 80' is such that the internal first bead 40' of upper perimeter closure member 150' in assembled condition, seats immediately under upper horizontal shoulder 82' and holds the container upper section 10' in position, even when the horizontal tear line 54' has been torn. Below the upper horizontal shoulder 82' is a second vertical exterior surface 84' which is substantially lesser in diameter than external neck bead 80'. Said vertical external surface 84' terminates at external neck bead 86'. Said external neck bead 86' has an outwardly-downwardly upper slant surface 88' which is rounded and merges with lower horizontal shoulder 90'. Below said external neck bead 86' there is a third lower vertical surface 92' which then merges with the external surface of the thicken base wall 78' formed by the intersection of exterior angled surface 76' and vertical neck 74'.

Figure 6C:
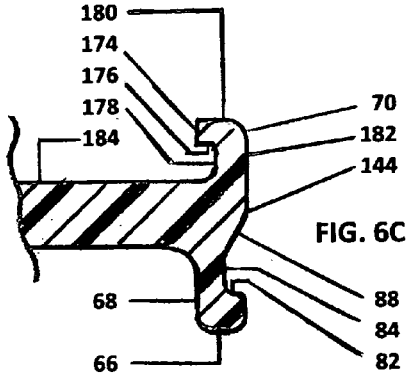
FIG. 6C is an enlarged vertical sectional view (6C-6C) of the alternate lower section-(base) detachable lid cover.

FIG. 6A and FIG. 6C show that the bottom edge of said alternate base 158 incorporates a new single bead and cavity structure. FIG. 6A shows horizontal surface 164 which intersects with the circumferential vertical bottom wall 166 which extends to intersects with the horizontal bottom lip 168 forming a recessed cavity to receive upper flange 70. Horizontal bottom lip 168, which extends downwardly to form the vertical external bead 170, is also molded to create and form the base bottom surface 172 of said alternate base 158. The resulting cavity created by the intersecting lines of horizontal bottom surface 164, said vertical bottom wall 166 and horizontal bottom lip 168 also provide for the attachment of an alternate lid cover 144 and snaps into alternate base 158. As shown in FIG. 6C, said alternate lid cover 144 comprises a horizontal top surface 180 that intersects with the vertical short wall 174 and extends down to connect with the horizontal short lip 176. A vertical catch wall 178 is formed with the intersecting of top surface 184. The resulting cavity created by the intersecting horizontal top surface 180, vertical short wall 174 and said horizontal short lip 176 create the in-turned upper flange 70 making possible attachment of said alternate lid cover 144 onto said vertical external bead 170 in the assembled position. It should be noted that only one vertical external bead 170 is mold incorporated in this embodiment.

As shown in FIG. 11, and detailed in FIG. 6C alternate lid cover 144 comprises a lid cover top surface 184 having a planar under bottom. Extending below and peripheral to the edge of said alternate lid cover 144 is a downward extending neck comprised of upper slant surface 88 vertical exterior surface 84 upper horizontal shoulder 82 horizontal sealing surface 66 and vertical sealing surface 68 which are molded to identical size and dimensions to the external neck bead 80 as shown in FIG. 6A. The resulting cavity formed by the intersecting of horizontal top surface 80 vertical short wall 174 horizontal short lip 176 vertical catch wall 178 and lid cover top surface 184 provide for an attachment cavity for alternate lid cover 144 after the separation of said presently preferred container 01. The lid cover 20 is used with presently preferred container 01 (single dispenser), with the alternate base 158 and alternate lid cover 144 used as an alternate design due to it having additional usage with a dual dispensing container 135 to be discussed later with respect to FIG. 17.

Figure 12:
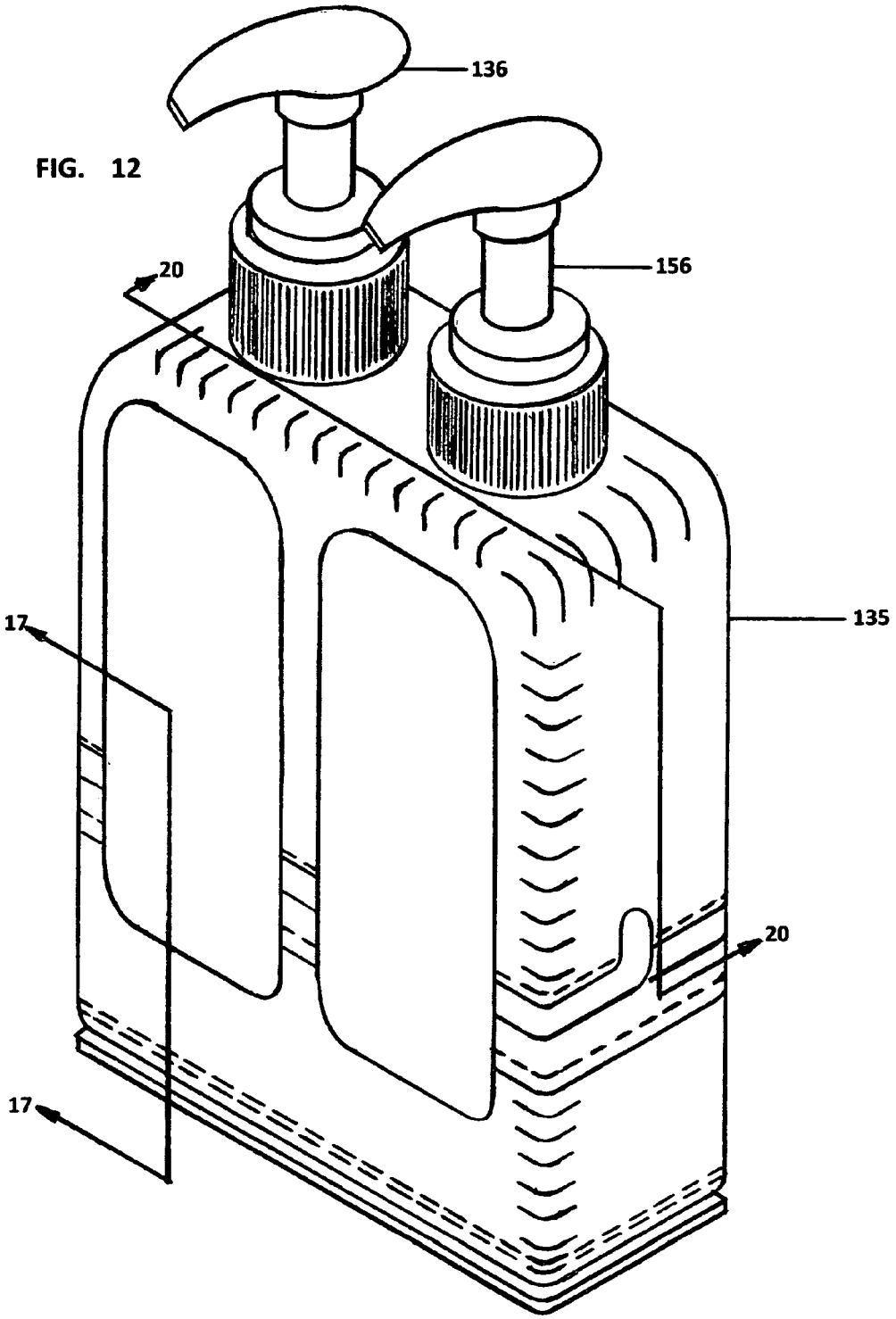
FIG. 12 is a perspective view of an alternate embodiment of the sectional container; dual dispensing from one container.
Figure 17:
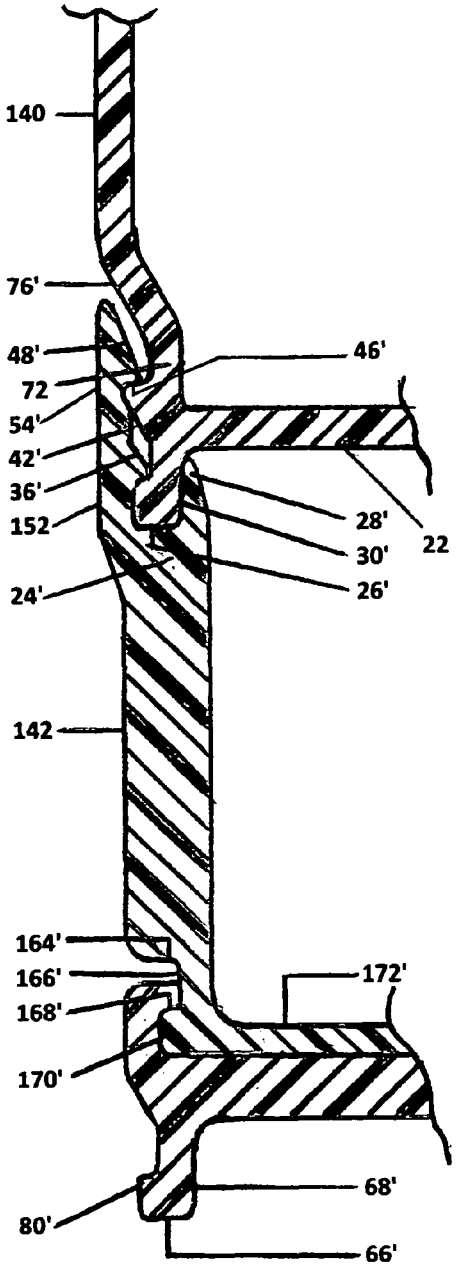
FIG. 17 is an enlarged sectional view (17-17) of the interior structure of said dual dispensing embodiment, showing the interlocking ridges for components in assembly.
Figure 18:
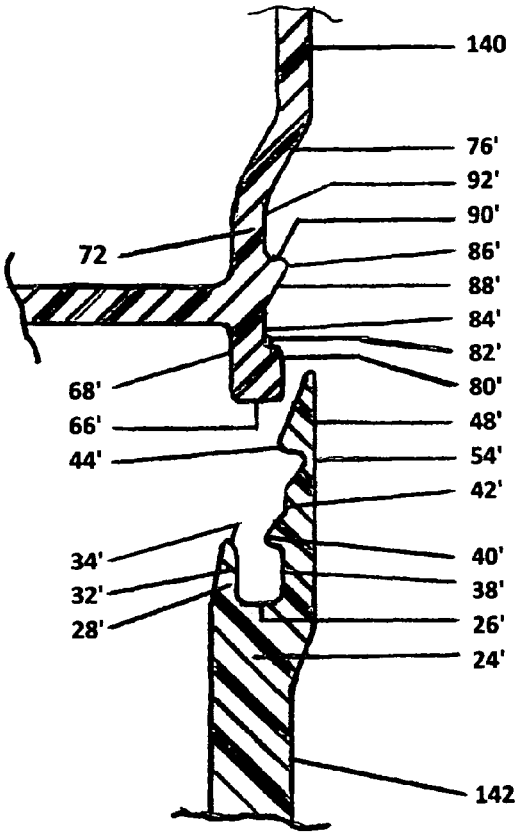
FIG. 18 is an exploded view of the structure of FIG. 17 (upper section) showing the closure members disassembled.

Another type of sectional container is shown in FIG. 12, FIG. 13 and FIG. 14. Referring to FIG. 12, FIG. 13, FIG. 17 and FIG. 18, two finger actuated pump dispensers PD 136 and finger actuated pump dispenser PD 156 are attached to the top of the dual dispensing container 135 by attaching to the upwardly extending neck #1 138 and upwardly extending neck #2 139 of dual dispensing container 135. Finger actuated pump dispenser PD 136 and finger actuated pump dispenser PD 156 may be of any commercially available type such as finger-operated pump dispensers used for dispensing healthcare lotions, creams, and soaps. In the assembled configuration, said dual dispensing container 135 consists of the dual dispensing upper container 140, the dual dispenser lower section (base) 142, said alternate lid cover 144' and the screw-in channel tube 162. The product information front label 146 and rear label 148 as shown in FIG. 16 and FIG. 16A respectively are assembled to the front and rear of said dual dispensing container 135 as required. Note it is within the scope of the dual dispensing configuration that pumps 135 and 156 can be associated with containers that are in any arrangement, such as containers that are joined by perimeter closure members such as upper perimeter closure member 150 and lower perimeter closure member 152, as best shown in FIG. 18 and FIG. 14, respectively.

Figure 20:
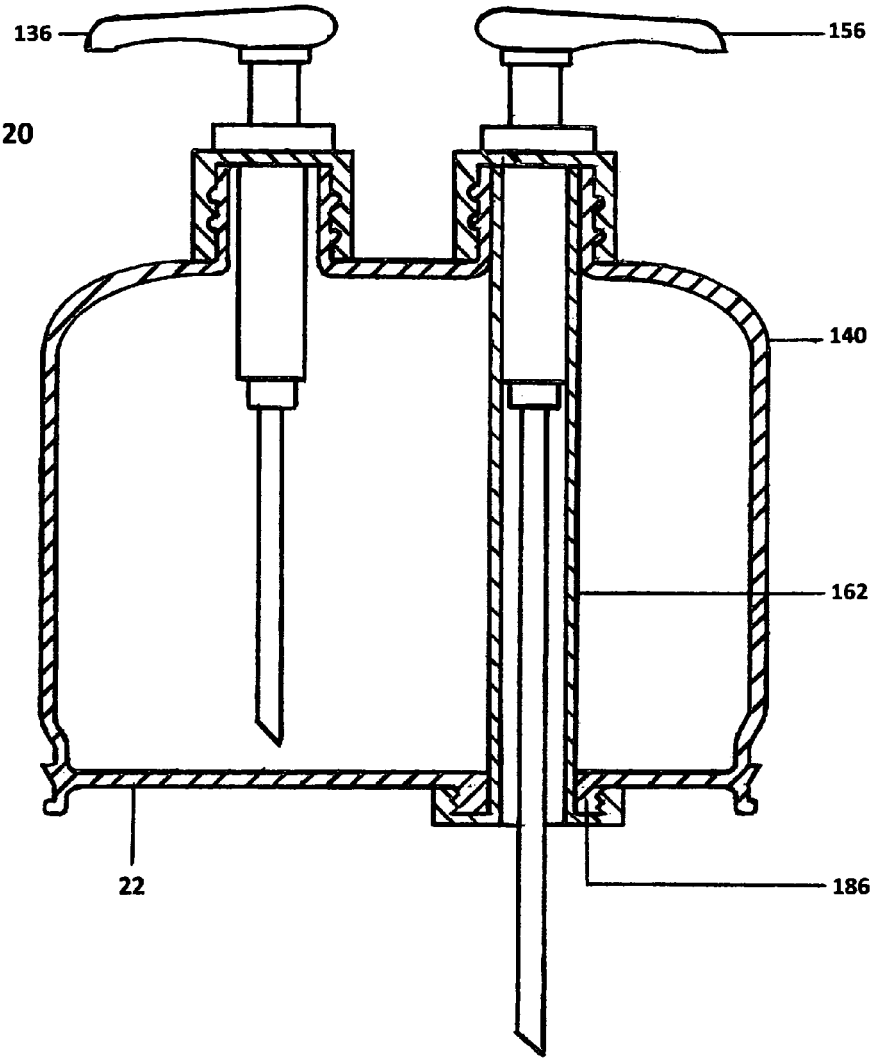
FIG. 20 is a sectional view of the interior structure of dual dispensing embodiment, with the disclosed finger actuated pump assemblies attached.

Referring to FIG. 13, FIG. 14, FIG. 15, FIG. 20 and FIG. 22 in the assembling of dual dispensing container 135 requires first inserting screw-in channel tube 162 into the short downward extending neck 186, best shown in FIG. 20, that is molded to the bottom surface of upper section 154 of dual dispensing upper container 140. Bottom surface of upper section 154 provides for enclosure of dual dispensing container 140 creating a second cavity for said dual dispensing upper container 135. Said screw-in channel tube 162 extends up and through upper extending neck #2 139 in a tight fit to the internal diameter of said upper extending neck #2 139, ending flush with the top edge of said upwardly extending neck #2 139. As shown in FIG. 13, the lower-most edge of dual dispenser upper container 140 contains a downward extending neck 72 which is aligned with the lower perimeter closure member 152 of dual dispensing lower section (base) 142 during assembly. Said dual dispensing lower section (base) 142 contains at its upper-most top edge said lower perimeter closure member 152 which aligns and mates with said downward extending neck 72 for assembly.

Figure 23:
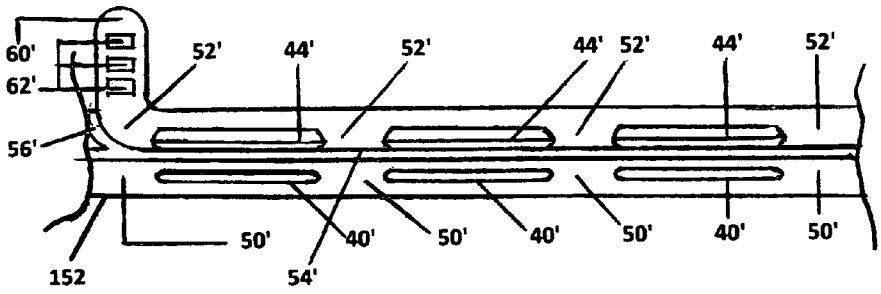
FIG. 23 shows a schematic view of the interior of the perimeter closure member and frangible tear-off band of sectional view (6-6) shown in FIG. 12.

Once alignment is established, continued compression of each component together until dual dispensing upper container 140 is locked together with dual dispensing lower section (base) 142. During the assembly, lower perimeter closure member 152 stretches to permit the slanted beads of downward extending neck 72 to slide over the internal beads of lower perimeter closure member 152 locking dual dispensing upper container 140 together with dual dispensing lower section (base) 142. The connection provides a tight and secure joining of each component. Dual dispensing lower section (base) 142 in its assembled position is locked into the bottom edge of dual dispensing upper container 140 by the frangible tear-off band 60' as shown in FIG. 23. As shown in FIG. 17, said frangible tear-off band 60' is molded as an integral part of said lower perimeter closure member 152 and attached above the horizontal tear line 54'. The internal first bead 40', in the assembled position provides restraint and holds dual dispensing lower section (base) 142 in a tightly sealed position. The internal lower bead 44' provides for additional sealing surfaces for securing dual dispensing lower section (base) 142 together to dual dispensing upper container 140. Said horizontal tear line 54' terminates in an upward spiral direction along the radius edge of said frangible tear band 60' as shown in FIG. 23.

Figure 19:
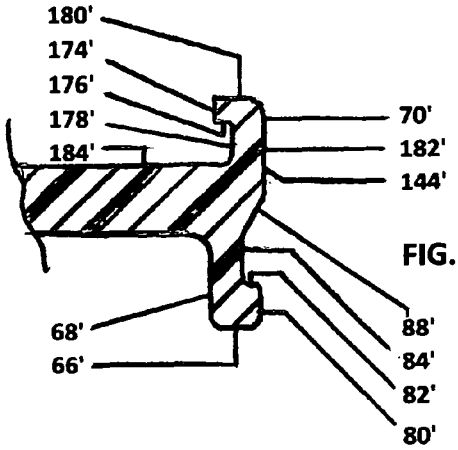
FIG. 19 is a sectional view of lid cover of said dual dispensing embodiment.

FIG. 17 As shown in the lower edge view of said dual dispensing lower section (base) 142 and peripheral to the external bottom edge, the vertical external bead 170' is formed by the extension of vertical bottom wall 166' which intersects with horizontal bottom lip 168' and thickens to dimensional size an thickness of external neck bead 80 as shown in FIG. 7 an extending to form the base bottom surface 172 of said dual dispensing lower section (base) 142. As shown in FIG. 19 horizontal top surface 180' extends and intersects with vertical short wall 174' and joins with horizontal short lip 176' to form the upper flange 70'. The attachment of an alternate lid cover 144' is accomplished by snapping upper flange 70' onto said vertical external bead 170' securing alternate lid cover 144' to the bottom underside of said dual dispensing lower section (base) 142.

Referring to FIG. 17, FIG. 18, and FIG. 19 show a more detailed description of said dual dispensing upper container 140. The upper container comprises along its bottom edge an exterior angled surface wall 76' which slants inwardly to intersect with said downwardly extending neck 72 containing two exterior neck beads. Intersecting with said exterior angled surface wall 76' is lower vertical surface 92'. Connecting in a ninety degree angle is a lower horizontal shoulder 90' which intersects with said upper slanted surface 88' to form upper exterior bead 86'. Below said upper neck bead 86' and extending vertically is vertical exterior surface 84' which intersects with said upper horizontal shoulder 82'. Upper horizontal shoulder 82' extends to form the second external neck bead 80'. Directly beneath said external neck bead 80' is horizontal sealing surface 66' which rests on the smooth planar surface 26' when assembled with said dual dispensing lower section (base) 142. Intersecting with the horizontal sealing surface 66' and extending in an upward direction is vertical seal surface 68' which extends to terminate at the bottom edge of said dual dispensing lower section (base) 142.

As shown in FIG. 17 and FIG. 18, said lower perimeter closure member 152 has been mold integrated into the top edge of said dual dispensing lower section (base) 142. Integrated at the upper-most edge is the angled top wall 24' having an upper planer surface 26'. Suspended from the upper edge in an internal direction is interior skirt 28' which is relatively short and has an outwardly slanted inner sealing surface 32', a slanted vertical inner wall 30', an inwardly tapered edge 34' which merges with the lower edge of inner sealing surface 32'.

As shown in FIG. 17 outwardly spaced and adjacent from said interior skirt 28' is said lower perimeter closure member 152 which has a substantially vertical top wall 38' extending vertically from said planar surface 26'. Said vertical top wall 38' terminates at the internal first bead 40' which intersects with the curved vertical wall 42' that terminates at the horizontal tear line 54'. Said horizontal tear line 54', merges with the slanted top surface 46' which intersects with the inclined lower surface 48' to form internal lower bead 44'. As best shown in FIG. 23, said internal first bead 40' and second internal lower beam 44' are not continuous but are interrupted with lower gap 52' and upper gap 50' respectively. It should be noted that a minimum of four lower gaps 52' and four upper gaps 50' are recommended to aid in assembly. The wall thickness of said lower perimeter closure member 152 and said internal first bead 40' and internal lower bead 44' is considerable thinner. This permits stretching of said lower perimeter closure member 152 during assembly. Said internal first bead 40' and internal lower bead 44' are considerably longer than said upper gap 50' and lower gap 52' respectively, size and quantity may vary. The internal lower bead 44' prevents dual dispensing upper container 140 from being removed from its assembled position. Spaced immediately below said internal lower bead 44' is said horizontal tear line 54' formed in a lesser thickness and horizontally above said internal first bead 40'. As shown in FIG. 23, extending upwardly in a slightly spiral direction is the spiral groove 56' which extends from the top edge of lower perimeter closure member 152 to merge with horizontal tear line 54'. Said frangible tear-off band 60' terminates in a sharp ninety degree angle, creating an upwardly turned tab. To assist in gripping said frangible tear-off band 60', raised traverse ridge 62' may be formed thereon.

FIG. 17 and FIG. 19 show that the bottom edge of said dual dispensing lower section (base) 142 shows a horizontal bottom surface 164' which intersects with the circumferential vertical bottom wall 166'. Said vertical bottom wall 166' intersects with the horizontal bottom lip 168' which extends downwardly to connect with the vertical external bead 170' which is molded creating the extended outer edge of said base bottom surface 172'. The resulting cavity created by intersecting bottom surface 164' vertical bottom wall 166' and horizontal bottom lip 168' creates an upper cavity for attachment of alternate lid cover 144'. As shown in FIG. 19 alternate lid cover 144' comprises a horizontal top surface 180' that intersects with vertical short wall 174' at a ninety degree angle. Said vertical short wall 174' extends downwardly to intersect with the horizontal short lip 176' which forming an in-flange that provides a retaining edge for said alternate lid cover 144' while in the assemble configuration. Intersecting with horizontal short lip 176 is the downward extending vertical catch wall 178'. Vertical catch wall 178' terminates at the intersection with lid cover top surface 184'. The resulting cavity created by the said intersecting of said horizontal lip 176' vertical catch wall 178' and said lid cover top surface 184' creates an additional attachment cavity for securing alternate lid cover 144' in the assembled position.

The exterior surface of the said alternate lid cover 144' contains a vertical outside wall 182' that extends and intersects with upper slant surface 88' and continues downwardly to intersect with vertical exterior surface 84'. Said vertical exterior surface 84' intersects with horizontal shoulder 82'. The external neck bead 80' is formed just below upper horizontal shoulder 82' and above the horizontal sealing surface 66'. Said horizontal sealing surface 66' intersects with the vertical seal surface 68' then intersects to form the bottom surface of alternate lid cover 144'.

As shown in a sectional view in FIG. 20, the assembled components of said dual dispensing upper container 140 contains two disclosed finger actuated pump assemblies PD 136 and PD 156. Screw-in channel tube 162 attaches to said short downward extending neck 186, said screw-in channel tube 162 is an injection molded part designed to vary in dimensional size and length. In FIG. 21 and FIG. 22 said screw-in channel tube 162 extends up and through interior of either of the aligned upper extending neck 138 or upper extending neck 139, terminating flush with its top edge. In FIG. 22 screw-in channel tube 162 is detailed to show the mold incorporated screw threads molded onto the interior surface of the flanged end. Screw in channel tube 162 is injection molded to various lengths and to accommodate various container neck sizes. Other attachment methods may be utilized to attach said screw-in channel tube 162 including bead and grooved snap-in designs.

FIG. 12, FIG. 17, FIG. 19 and FIG. 23 show that when a consumer decides to sectionalize said dual dispensing container 135 the consumer should first grip said frangible tear-off band 60' and pull upwardly causing said lower perimeter closure member 152' to tear along horizontal tear line 54' and to continue pulling said frangible tear-off band 60' until complete removal from said dual dispensing container 135 is achieved. As shown in FIG. 23 said frangible tear-off band 60' comprises an upward turned tab of various lengths and shape. To remove dual dispensing upper container 140, the consumer would then apply an upward prying motion twisting and lifting away of said dual dispensing upper container 140, thus breaking the seal at said internal first bead 40' and upper horizontal shoulder 82'. To detach alternate lid cover 144' from its assembled position, consumer simply grips alternate lid cover 144' at the lower most vertical outside wall 182', placing a thumb or finger in the recessed area created by the intersection of said upper slant surface 88'. The consumer can then use downward pressure concentrated on the recessed area while breaking free the bond between said horizontal bottom lip 168' with said horizontal short lip 176'. Said alternate lid cover 144' can now be removed completely from its assembled position.

In this second embodiment, said dual dispensing container 135 makes possible dual dispensing of two different liquids used in combination by consumers (hair conditioners & shampoo, facial scrubs and creams, or foaming cleansers & lotions, etc.). The present invention combines two or more products into one container having multiple compartments, such that each product is held in its own separate compartment in that container. In addition, the compartments can be of different sizes with respect to each other. The dual dispensing upper container 140 in this design configuration is molded to an increased width to accommodate said additional disclosed finger actuated pump assembly in addition to widening of said dual dispensing lower section (base) 142, which provides for additional liquid storage capacity for the additional product. In a preferred product placement arrangement within container design, said dual dispensing lower section (base) 142 would contain the heavier bodied product while said dual dispensing upper container 140 would contain the more fluid liquids (facial cleansers, sanitizing soaps, etc.).

Although closure members 150,152 are shown as being place around the horizontal circumference of the dual dispensing container, it's within the scope of this presently preferred embodiment that the container can be equipped with closure members that encircle the container in a vertical orientation. While I have shown and described several embodiments in accordance with the present invention, it is to be understood that the invention is not limited thereto, but is susceptible to numerous changes and modifications as known to a person skilled in the art, and I therefore do not wish to be limited to the details shown and described herein but intend to cover all such changes and modifications as are obvious to one of ordinary skill in the art.

| Drawing Reference Numerals | PART NAME |
|---|---|
| 01. | Presently preferred container |
| 10. | Upper section |
| 12. | Upper extending neck |
| 14. | Front product adhesive label |
| 16. | Rear product adhesive label |
| 18. | Lower section (base) |
| 20. | Lid cover |
| 22. | Interior bottom surface |
| 24, 24'. | Angled top wall |
| 26, 26'. | Planer surface |
| 28, 28'. | Interior skirt |
| 30, 30'. | Vertical inner wall |
| 32, 32'. | Inner sealing surface |
| 34, 34'. | Tapered edge |
| 36, 36'. | Slanted interior surface |
| 38, 38'. | Vertical top wall |
| 40, 40'. | Internal first bead |
| 42, 42'. | Curved vertical wall |
| 44, 44'. | Internal lower bead |
| 46, 46'. | Slanted top surface |
| 48, 48'. | Inclined lower surface |
| 50, 50'. | Upper gap |
| 52, 52'. | Lower gap |
| 54, 54'. | Horizontal tear line |
| 56, 56'. | Spiral Groove |
| 58. | Bottom skirt edge |
| 60, 60'. | Frangible tear-off band |
| 62, 62'. | Traverse ridge |
| 64, 64'. | In-turned top flange |
| 66, 66'. | Horizontal sealing surface |
| 68, 68'. | Vertical seal surface |
| 70, 70'. | Upper flange |
| 72. | Downward extending neck |

-continued

| Drawing Reference Numerals | PART NAME |
|---|---|
| 74, 74'. | Vertical neck |
| 76, 76'. | Angled surface wall |
| 78, 78'. | Thicken base wall |
| 80, 80'. | External neck bead |
| 82, 82'. | Upper horizontal shoulder |
| 84, 84'. | Vertical exterior surface |
| 86, 86'. | External neck bead |
| 88, 88'. | Upper slant surface |
| 90, 90'. | Lower horizontal shoulder |
| 92, 92'. | Lower vertical surface |
| 94. | Bottom disk |
| 96. | Lower perimeter closure member |
| 98. | Short vertical wall |
| 100. | Internal lower bead |
| 102. | Outwardly slanted surface |
| 104. | Internal upper bead |
| 105. | Lower short gap |
| 106. | Upper short gap |
| 108. | Inclined upper surface |
| 110. | Horizontal tear line |
| 112. | Spiral tear groove |
| 114. | Top skirt edge |
| 116. | Frangible tear-off band |
| 118. | Traverse ridge |
| 120. | Angled external surface |
| 122. | First vertical surface |
| 123. | First external bead |
| 124. | Lower horizontal shoulder |
| 126. | Lower external vertical wall |
| 128. | Outwardly slanted surface |
| 130. | Second external bead |
| 132. | Upper horizontal shoulder |
| 134. | Intersecting vertical wall |
| 135. | Dual dispensing container |
| 136. | Finger actuated pump |
| 138. | Upper extending neck #1 |
| 139. | Upper extending neck #2 |
| 140. | Dual dispensing upper container |
| 142. | Dual dispensing lower section (base) |
| 144, 144'. | Alternate lid cover |
| 146. | Front labels (dual) |
| 148. | Rear labels (dual) |
| 150. | Upper perimeter closure member |
| 152. | Lower perimeter closure member |
| 154. | Bottom surface of upper section |
| 156. | Finger actuated pump |
| 158. | Alternate base (snap-on lid cover) |
| 160. | Alternate lid cover (snap-on) |
| 162. | Screw in channel tube |
| 164, 164'. | Horizontal bottom surface |
| 166, 166'. | Vertical bottom wall |
| 168, 168'. | Horizontal bottom lip |
| 170, 170'. | Vertical external bead |
| 172, 172'. | Base bottom surface |
| 174, 174'. | Vertical short wall |
| 176, 176'. | Horizontal short lip |
| 178, 178'. | Vertical catch wall |
| 180, 180'. | Horizontal top surface |
| 182, 182'. | Vertical outside wall |
| 184, 184'. | Lid cover top surface |
| 186. | Short downward extending neck |

I claim:

1. A sectional liquid dispenser, comprising:

a dual dispensing container having a lower base section and an upper section and further having two upwardly extending pump assembly necks, integrated on an upper surface of the upper section, that are provided with coupling means, and;

two finger actuated pump assemblies, each being connected in operative relation to a respective one of the two upwardly extending pump assembly necks of the dual dispensing container such that liquid contained in the dual dispensing container may be selectively dispensed by the manipulation of the finger actuated pump assemblies;

a perimeter closure assembly, including an upper perimeter closure element and a lower perimeter closure element, that incorporates a frangible tear-off band that allows for the separation of the upper section of the dual dispensing container from the lower section of the dual dispensing container and that provides for tamper evident detection, the frangible tear-off band being formed as an integral part of the lower base section of the dual dispensing container;

wherein the upper and lower sections of the dual dispensing container are individually molded and are assembled together by compression fitting each together, wherein the upper section has integrated at its lowest exterior edge a downwardly extending neck that includes the upper perimeter closure element, and wherein the lower base section has integrated at its upper edge the lower perimeter closure element which incorporates the frangible tear-off band, such that the upper section and the lower base section are assembled together to provide for a liquid tight seal for the dual dispensing container;

wherein separation of the dual dispensing container provides access to contents remaining therein after either finger actuated pump assembly fails to dispense all of its contents, such access being facilitated by the removal of the frangible tear-off band from its attached position with the lower perimeter closure element;

wherein the dual dispensing container upper section can be separated from the dual dispensing container lower base section by an upwardly pull of the upper section away from the lower base section, and wherein:

the upper section of the dual dispensing container has at its lowest edge an upper angled surface wall, the upper perimeter closure element of the downwardly extending neck has an outer periphery with integrated neck beads formed to compression fit into said lower perimeter closure element, the integrated neck beads providing restraint and preventing the upper section of the dual dispensing container and the lower base section of the dual dispensing container from separating out of their assembled position, the lower base section has mold-integrated internal beads that mate in assembly with external beads of the upper section of the dual dispensing upper container, the downwardly extending neck has a bottom flange with a flat horizontal sealing surface, an upper external neck bead, and a lower external neck bead vertically spaced from the upper neck bead, each of the neck beads having substantially horizontal shoulders on its upper edge and providing sealing surfaces for the beads of the lower base section; and wherein the upper section of the dual dispensing container has, on its bottom surface and underneath, an integrated short downwardly extending neck, the short downwardly extending threaded exterior neck being centrally aligned with one of the two upwardly extending pump assembly necks, wherein the short downwardly extending neck is externally threaded to receive a screw-in channel tube which extends internally to a top edge of the upwardly extending pump assembly neck with which it is aligned, wherein the screw-in channel tube is connected to the short downwardly extending neck in a fluid-tight relation as it extends upwards into the interior of the aligned neck, and wherein at least one of the finger actuated pump assemblies includes a dip tube, whereby the dip tube can be extended into the lower base section of the assembled dual dispensing container.

2. The sectional liquid dispenser of claim 1:

wherein an angled top wall is disposed at an upper most edge of the lower base section of the dual dispensing container, wherein the lower perimeter closure element is of substantially uniform thickness and depends from a periphery of the angled top wall, wherein the lower perimeter closure element is scored and weakened to form a peripheral horizontal tear line which extends up to a bottom edge of the lower perimeter closure element, a frangible tear-off band positioned around the periphery and attached to the upper edge of lower perimeter closure element;

wherein the mold-integrated internal beads of the lower base section include an upper internal first bead on the lower perimeter closure element located between the horizontal tear line and the top surface, a internal second bead on the lower perimeter closure element located below but adjacent to the horizontal tear line, both of the beads being interrupted in a series of upper gaps and lower gaps spaced around the periphery of the lower perimeter closure element; and wherein the lower base section further includes a short interior skirt depending from the angled top wall spaced inwardly from the lower perimeter closure element, the short interior skirt having a slanted interior with an inwardly tapered edge at the top;

wherein the lower base section of the dual dispensing container has, integrated onto its lowest most exterior surface, a single peripheral vertical external bead depending from the bottom edge thereof;

wherein the lower base section further includes, on the bottom thereof, a detachable lid cover that may be removed from the bottom of the lower base section and installed on a top of the lower base section; and wherein the lower base section of the dual dispensing container includes, above the single peripheral vertical external bead, and at approximately the same height as the single peripheral vertical external bead, a peripheral recessed vertical bottom wall which intersects with, and forms a flat horizontal bottom lip relative to, the single peripheral vertical external bead, wherein the horizontal bottom lip and the single peripheral vertical external bead provide a restraining surface for the detachable lid cover, whereby said single peripheral vertical external bead provides for secure snap-on attachment of the detachable lid cover.

3. The sectional liquid dispenser of claim 2:

wherein the detachable lid cover includes a central top disk that includes a horizontal top surface that intersects with a short, first vertical wall, extending upwards to intersect with a horizontal short lip, thereby forming an in-turned flange that provides a retaining edge for attachment of the detachable lid cover, an external, second vertical wall that:

extends and intersects with an upper slant surface that continues on to intersect with a vertical exterior surface wall extending to a horizontal shoulder and forming a horizontal sealing surface at the lower edge, and connects with a vertical seal surface which forms an external neck bead and which is dimensionally the same size and shape as the downwardly extending neck bead of the upper section of the dual dispensing container; and whereby the detachable lid cover can be removed by tilting the lid cover off the lower base section and can then be attached to the top edge of said dual dispensing lower base section.

* * * * *